US006842916B1

(12) United States Patent
Gunn et al.

(10) Patent No.: US 6,842,916 B1
(45) Date of Patent: Jan. 18, 2005

(54) TOILET SEAT AND LID SELECTIVE LIFTING HANDLE

(76) Inventors: Justin Gunn, 1236 1/2N. Crescent Heights Blvd., Los Angeles, CA (US) 90046; Christian Gunn, 1236 1/2N. Crescent Heights Blvd., Los Angeles, CA (US) 90046

( * ) Notice: Subject to any disclaimer, the term of this patent is extended or adjusted under 35 U.S.C. 154(b) by 0 days.

(21) Appl. No.: 10/639,091

(22) Filed: Aug. 12, 2003

(51) Int. Cl.[7] ..... A47K 13/10
(52) U.S. Cl. ..... 4/246.1
(58) Field of Search ..... 4/246.1

(56) References Cited

U.S. PATENT DOCUMENTS

| | | | | |
|---|---|---|---|---|
| 2,318,518 | A | 5/1943 | Opperer | 4/251 |
| 5,027,472 | A | 7/1991 | Goodman | 16/422 |
| 5,459,889 | A | 10/1995 | Jamison | 4/661 |
| 5,461,733 | A | 10/1995 | McKee | 4/246.1 |
| 5,511,252 | A | 4/1996 | Kreemer | 4/246.1 |
| 5,553,332 | A | 9/1996 | Hazard | 4/246.1 |
| 5,619,758 | A | 4/1997 | Burkett | 4/246.1 |
| 5,713,084 | A | 2/1998 | Greco | 4/246.1 |
| 5,727,258 | A | 3/1998 | Derouin | 4/246.1 |
| 5,963,992 | A | 10/1999 | Bonner | 4/246.1 |
| 6,009,569 | A | 1/2000 | Ferrara | 4/246.3 |
| D426,875 | S | 6/2000 | Weatherbee | D23/311 |
| 6,163,894 | A | 12/2000 | Simonds | 4/246.1 |
| 6,212,694 | B1 | 4/2001 | Porzio | 4/246.1 |
| 6,263,517 | B1 | 7/2001 | Brooks | 4/246.1 |
| 6,305,032 | B1 | 10/2001 | Jones | 4/246.1 |
| 6,385,782 | B1 | 5/2002 | Schneider | 4/239 |
| 6,415,454 | B1 | 7/2002 | Pierson | 4/246.1 |

*Primary Examiner*—Charles E. Phillips
(74) *Attorney, Agent, or Firm*—Goldstein Law Offices, P.C.

(57) ABSTRACT

A toilet seat lifting device, for use in lifting a toilet seat lid and selectively simultaneously lifting a toilet seat, having a housing, a handle slidably mounted within the housing, a hook attached beneath the handle and an adhesive pad located on the housing. The adhesive pad is affixed to the toilet seat lid. The user slides the handle between an outward position when only the toilet seat lid is being lifted, and an inward position where the hook engages the toilet seat so that when the handle is lifted the toilet seat will be lifted along with the toilet seat lid.

5 Claims, 4 Drawing Sheets

TOILET SEAT AND LID SELECTIVE LIFTING HANDLE

BACKGROUND OF THE INVENTION

The invention relates to a toilet seat and lid lifting handle. More particularly, the invention relates to a handle which allows the user to selectively lift a toilet seat lid, and selectively simultaneously lift the toilet seat and toilet seat lid.

Conventional toilets have a bowl having a rim, and a seat hingeably attached to the bowl at the rear of the rim. The seat can either extend in a horizontal position, resting upon the bowl, or in a vertical position. In addition, a toilet seat lid is typically hingeably attached to the bowl, coaxially with the toilet seat, for selectively covering the toilet seat, and selectively extending vertically at a substantially ninety degree angle therefrom.

During various modes of usage, either the lid alone is raised vertically while the seat extends horizontally; both the lid and seat are raised vertically; or both the lid and seat rest horizontally upon the rim. To move the seat and/or lid between these various positions, the user must typically manually grab the toilet seat and position it accordingly.

It is well known, however, that a variety of germs and pathogens are transmitted through toilet seats. In addition, considering that the toilet is often used by strangers, most people find it unpleasant to touch the toilet seat.

Various devices have been proposed which seek to aid a person in lifting a toilet seat without actually touching the seat. For example, U.S. Pat. No. 5,461,733 to McKee discloses a lifting device, which includes an elongated arm that attaches to the side of the a toilet seat. U.S. Pat. No. 5,713,084 to Greco discloses a toilet seat lift mechanism that includes a bar, which is attached behind the seat, and an arm pivotally mounted to the bar. U.S. Pat. No. 6,212,694 to Porzio discloses a device that attaches to the toilet seat lid, and which selectively clips to the toilet seat from within. U.S. Pat. No. 6,163,894 to Simonds discloses a clip-on handle that is selectively attached to the seat and lid for use and may be tethered to the side of the bowl. U.S. Pat. No. 5,459,889 to Jamison discloses a seat handle that has a mechanism for holding the seat in the vertical position. U.S. Pat. No. 5,619,758 to Burkett discloses a hand-held toilet seat lifting device that allows a user to selectively grab a toilet seat from a distance. U.S. Pat. No. Des. 426,875 discloses an ornamental design for a combined toilet seat and lid lifter set.

U.S. Pat. No. 2,318,518 to Opperer discloses a lifting handle device for toilet seats and covers. Opperer is attached at the front of a toilet seat lid with screws, and has a lower lip that engages the toilet seat. Opperer is biased against the seat with a spring.

While these units may be suitable for the particular purpose employed, or for general use, they would not be as suitable for the purposes of the present invention as disclosed hereafter.

SUMMARY OF THE INVENTION

It is an object of the invention to provide a toilet seat lifting device that allows the toilet seat to be lifted by a user without touching the toilet seat. Accordingly, the lifting device provides a handle, which the user can grasp when lifting the toilet seat.

It is another object of the invention to provide a toilet seat lifting device that allow the user to selectively grasp just the toilet seat lid, or both the toilet seat lid and toilet seat. Accordingly, the handle has an inwardly extending hook and is mounted to the toilet seat lid for radial movement with respect to the toilet seat lid between an outward and an inward position, wherein the handle is moved radially inward to the inward position to engage the toilet seat rim with the hook so that when the handle is lifted it carries both the toilet seat lid and the toilet seat.

It is yet another object of the invention to provide a toilet seat lifting device that is easily installed onto existing toilets. Accordingly, the toilet seat lifting device is adhesively mounted to any toilet seat lid, and the clip is configured to expand to accommodate toilet seats of varying thicknesses.

It is a further object of the invention to provide a toilet seat lifting device that is inexpensive to manufacture. Accordingly, the toilet seat lifting device is simplistic in construction, has minimal components, and may be constructed largely of plastic.

It is yet a further object of the invention to allow the user to easily select between lifting the toilet seat lid only, and simultaneously lifting the toilet seat and the toilet seat lid. Accordingly, the handle is configured so that when the hook engages the toilet seat, the user may lift the toilet seat with an upward motion of the handle. To disengage the handle from the toilet seat, however, the user need only move the handle outwardly.

The invention is a toilet seat lifting device, for use in lifting a toilet seat lid and selectively simultaneously lifting a toilet seat, having a housing, a handle slidably mounted within the housing, a hook attached beneath the handle and an adhesive pad located on the housing. The adhesive pad is affixed to the toilet seat lid. The user slides the handle between an outward position when only the toilet seat lid is being lifted, and an inward position where the hook engages the toilet seat so that when the handle is lifted the toilet seat will be lifted along with the toilet seat lid.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
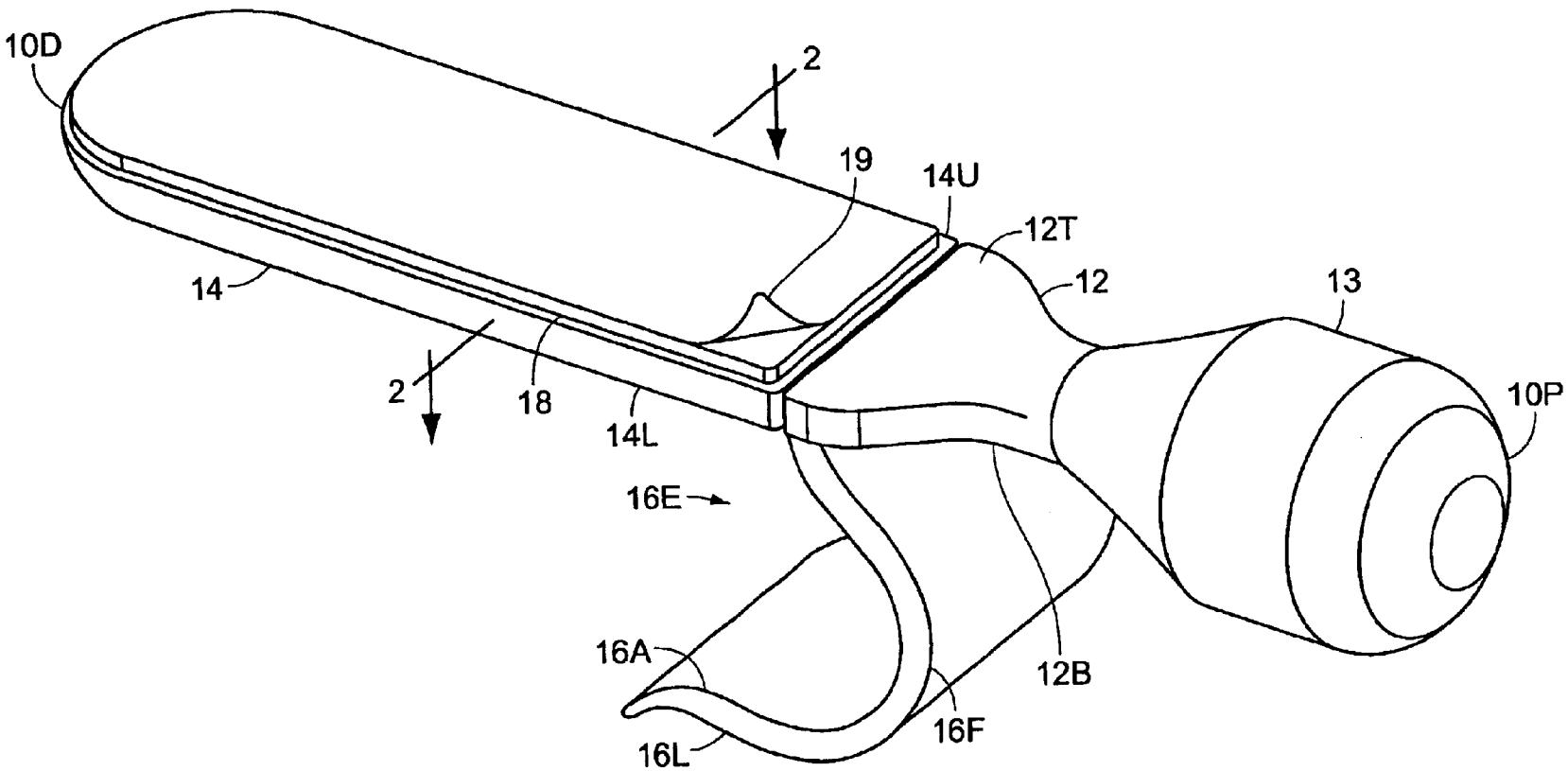
FIG. 1 is a diagrammatic perspective view, illustrating the toilet seat lifting device per se, wherein the adhesive patch is still covered by a non-adhesive backing—which is shown being peeled from the adhesive patch for installation.

FIG. 1 illustrates a toilet seat lifting device 10 having a proximal end 10P and a distal end 10D. The lifting device 10 further has a handle 12, a housing 14, an inwardly extending hook 16 extending distally beneath the handle, and an adhesive pad 18 mounted upon the housing 14. The handle 12 has a handgrip 13 located at the proximal end 12. In addition, the housing 14 has an upper surface 14U and a lower surface 14L. Similarly, the handle 12 has a top 12T and a bottom 12B. The top 12T and upper surface 14U are substantially parallel and coextensive. The bottom 12B and lower surface 14L are also substantially parallel and coextensive.

The adhesive pad 18 is mounted upon and securely affixed to the upper surface 14U of the housing 14. A backing sheet 19 covers the adhesive pad 18 prior to installation to prevent the adhesive pad 18 from inadvertently sticking to objects and to preserve the adhesive until needed. The adhesive pad preferably extends across substantially the entire upper surface 14U to provide significant area for creating a strong bond upon installation.

The inwardly extending hook 16 has a front portion 16F and a lower portion 16L. The front portion 16F extends substantially downwardly, curves forwardly (proximally), and then curves rearwardly toward the lower portion 16L. The lower portion 16L extends somewhat parallel to the bottom 12B of the handle and has an apex 16A whose tangent is substantially parallel to the bottom 12B of the handle 12 and lower surface 14L of the hook 16. The lower portion 16L and front portion 16F of the hook that together create an open end 16E for selectively grasping a toilet seat, which will be described in further detail hereinbelow.

Figure 2:
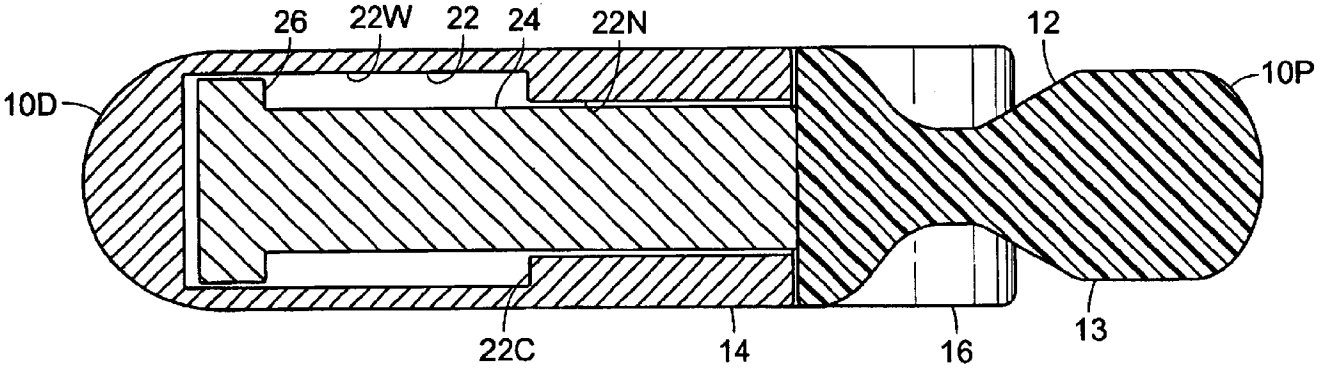
FIG. 2 is a cross sectional view, taken generally in the direction of line 2—2 in FIG. 1, showing the handle slidably mounted within the housing in an inward position.
Figure 3:
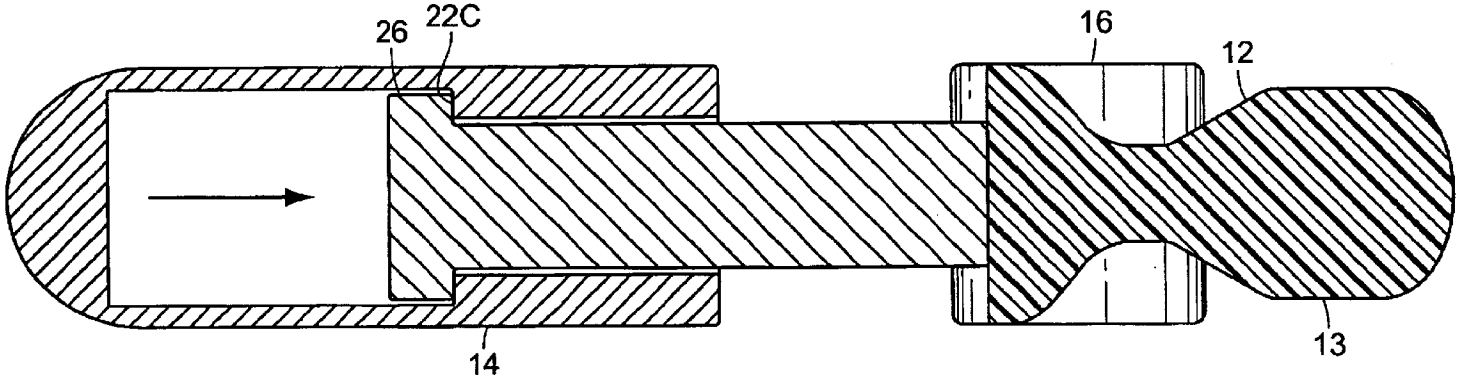
FIG. 3 is a cross sectional view, similar to FIG. 2, except wherein the handle is slid longitudinally outward within the handle housing to an outward position.

FIG. 2 illustrates the slidable connection between the handle 12 and the housing 14. In particular, the housing 14 has an internal channel 22 having a narrow portion 22N near the proximal end 10P and a wide portion 22W near the distal end 10D. The narrow portion 22N and wide portion 22W meet at is a catch 22C. The narrow portion 22 also has a distal wall 22D fully distally 22D therein, and an opening 22A fully proximal. The handle 12 has a shaft 24 that extends distally from the handgrip 13 and is sized to slide longitudinally within the narrow portion 22N, and a flange 26 that protrudes laterally from the shaft 24 fully distally on the shaft 24. Referring momentarily to FIG. 3, when the handle 12 is slid fully proximally, the flange 26 engages the catch 22C and thereby prevents the handle 12 from moving further proximally, and thereby keeps the shaft 24 within the channel 22 of the handle 12. Accordingly, the catch 22C and distal wall 22D limit the longitudinal travel of the flange 26 between an outward position, seen in FIG. 3 and FIG. 5, and an inward position, seen in FIG. 1, FIG. 2 and FIG. 4.

Figure 5:
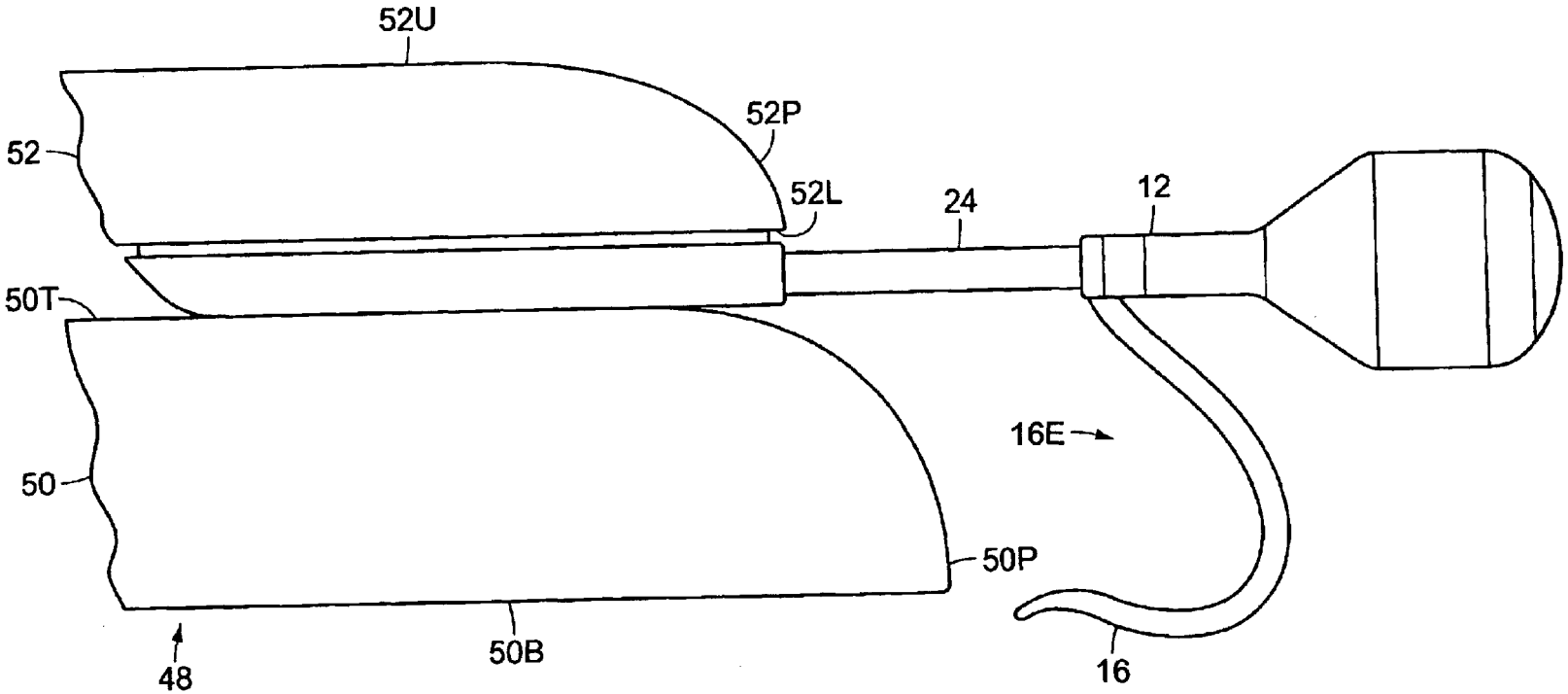
FIG. 5 is a side elevational view, similar to FIG. 4, except wherein the handle is in its outward position, such that the hook is free of the toilet seat, whereby if the handle is lifted it will only lift the toilet seat lid.

Also seen in FIGS. 2 and 3, since the hook 16 is attached to the handle 12 just beneath the handgrip 13, as the handgrip is pulled outward to the outward position, the hook 16 is pulled outward. This is in furtherance of the purpose of the slidable mounting of the handle 12 within the housing 14—to allow the hook 16 to selectively engage the toilet seat. In particular, as seen in FIG. 5 a standard toilet seat assembly 48 includes a toilet seat 50 and a toilet seat lid 52. The toilet seat lid 52 is located above the toilet seat 50.

The toilet seat has an outer periphery 50P, a top 50T, a bottom 50B, and a thickness between the top 50T and bottom 50B. The toilet seat lid 52 has an outer periphery 52P, an upper surface 52U and a lower surface 52L. Although not shown, the toilet seat assembly 48 is mounted upon a toilet bowl, having a rim having a rear, wherein the toilet seat 50 substantially covers the rim, and wherein the toilet seat and toilet seat lid are hingeably attached to the bowl with a coaxial hinge.

Figure 4:
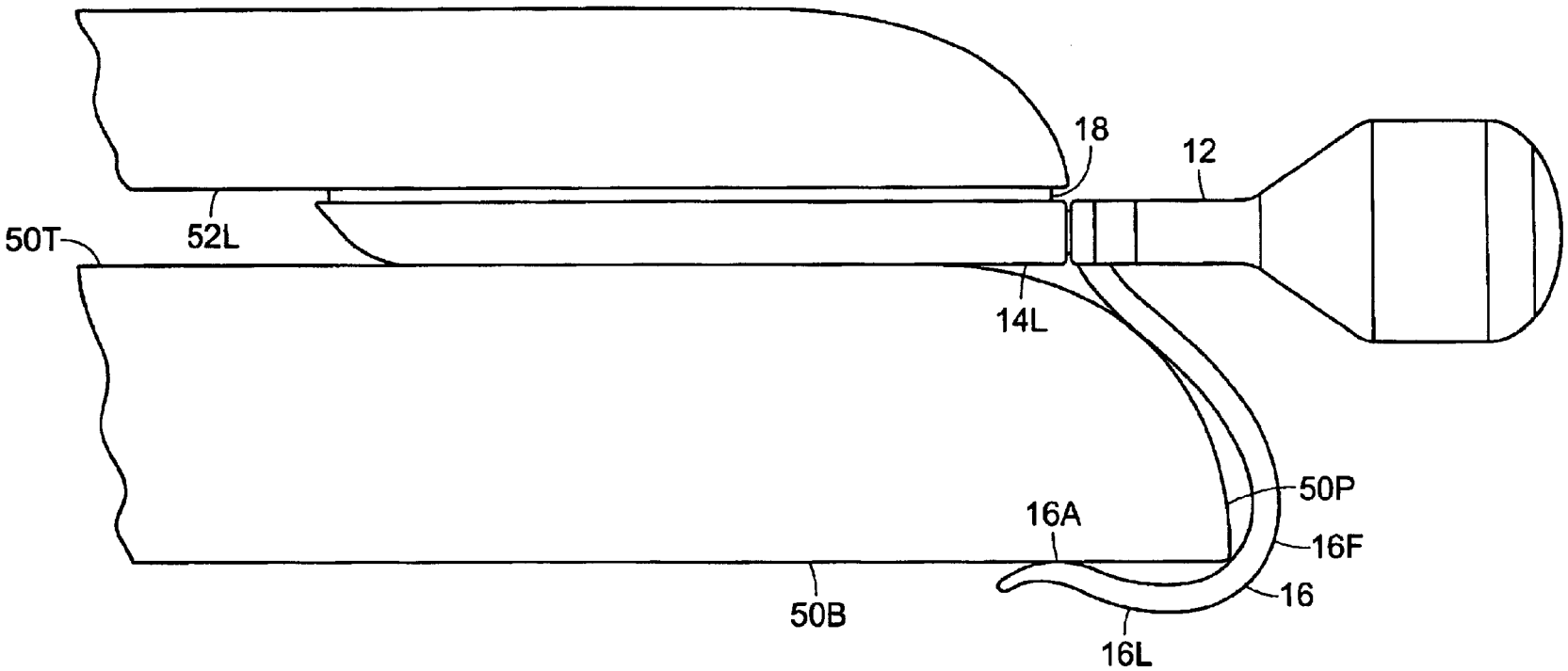
FIG. 4 is a side elevational view, illustrating the toilet seat lifting device installed, wherein the upper surface of the handle housing is adhered to the lower surface of the toilet seat lid, wherein the handle is in its inward position such that the hook is engaging the outer rim of the toilet seat, and wherein if the handle is lifted it will lift both the toilet seat lid and the toilet seat.

As seen in FIG. 4, the adhesive pad 18 is attached to the lower surface 52L of the toilet seat lid. Accordingly, regardless of whether the handle 12 is in the inward position as shown in FIG. 4, or the outward position shown in FIG. 5, when the handle 12 is lifted upward by the handgrip 13, the toilet seat lid 52 is always lifted.

Moving the handle 12 from the outward position illustrated in FIG. 5 to the inward position illustrated in FIG. 4, however, allows the toilet seat 50 to be lifted simultaneously with the toilet seat lid 52. In particular, when the handle 12 is moved inward, the hook 16 engages the periphery 50P of the toilet seat 50, whereas the periphery 50P extends into the open end 16E of the hook 16, the upper surface 50U of the toilet seat 50 contacts the lower surface 14L of the housing, and the forward portion 16F and lower portion 16L of the hook 16 flexes to accommodate the thickness of the toilet seat 50. The apex 16A of the lower portion 16L of the hook remains in contact with the toilet seat bottom 50B and is biased thereagainst to keep the toilet seat 50 firmly within the hook 16. Once again, if the user wishes to only lift the toilet seat lid 52, the handle is slid laterally outward, to the outward position, so that the hook 16 becomes disengaged from the toilet seat 50 and then the handle is lifted upward.

In conclusion, herein is presented a toilet seat lifting device that allows a toilet seat lid to be lifted by itself or along with the toilet seat lid, using a handle that is grasped by the user and eliminates the necessity for the user to touch the toilet seat or toilet seat lid. The invention is illustrated by example in the drawing figures, and throughout the written description. It should be understood that numerous variations are possible, while adhering to the inventive concept. Such variations are contemplated as being a part of the present invention.

What is claimed is:

1. A toilet seat lifting device, having a proximal and distal end, for use with a toilet seat assembly having a toilet seat and a toilet seat lid, the toilet seat and toilet seat lid each having a periphery, the toilet seat lid having upper and lower surfaces, and the toilet seat having a top and bottom, comprising:

a housing having an upper surface, and a lower surface, the housing having an internal channel having an opening at the proximal end;

an adhesive pad attached to the upper surface of the housing for mounting the housing to the lower surface of the toilet seat lid;

a handle having a handgrip and a shaft, the handgrip located fully proximally on the handle and more proximal than the housing, the shaft slidably mounted within the internal channel for allowing the handle to selectively enter an inward position and an outward position; and a hook attached to and extending beneath the handle near the handgrip, the hook for selectively engaging the perimeter of the toilet seat when the housing is affixed to the toilet seat lid associated with said toilet seat and the hook is in the inward position, wherein the hook has a forward portion that extends downwardly from the handgrip and a lower portion having an apex for selectively engaging the toilet seat bottom whereas the hook flexes against the toilet seat bottom and is biased there against to keep the hook in position against the toilet seat perimeter.

2. The toilet seat lifting device as recited in claim 1, wherein the channel has a narrow portion near the proximal end, a wide portion near the distal end, a catch located between the narrow portion and wide portion, and a distal wall fully distally within the channel; wherein the handle has a flange fully distally thereon, the shaft freely movable longitudinally within the wide portion but not capable of moving past the catch into the narrow portion of the channel such that the catch and distal wall together limit the travel of the handle and define the outward and inward positions of the handle, respectively.

3. A toilet seat lifting method, for use with a toilet seat assembly having a toilet seat and a toilet seat lid, the toilet seat and toilet seat lid each having a periphery, the toilet seat lid having upper and lower surfaces, the toilet seat having a top and bottom, using a lifting device having a housing having an upper surface, a lower surface, and a channel, a handle having a shaft that extends within the channel and is slidably mounted therein, a hook attached beneath the handle, an adhesive pad mounted on the upper surface of the housing, comprising the steps of:

affixing the housing to the toilet seat lid by adhering the adhesive pad to the lower surface of the toilet seat lid near the perimeter of the toilet seat lid;

lifting the toilet seat lid by lifting the handle upward;

engaging the toilet seat with the device by sliding the shaft into the housing, extending the toilet seat into the open end of the hook, and flexing the hook to be biased against the toilet seat bottom; and lifting the toilet seat and toilet seat lid simultaneously by lifting the handle upwards.

4. The toilet seat lifting method as recited in claim 3, wherein the handle has a handgrip located on one end of the shaft and a flange on an opposite end of the shaft, wherein the hook is located immediately below the handgrip, wherein the channel has a distal wall and a catch, wherein the step of lifting the toilet seat lid by lifting the handle upwards is conducted while the flange is located near catch, and wherein the step of engaging the toilet seat further comprises sliding the flange toward the distal wall.

5. The toilet seat lifting method as recited in claim 4, wherein the device further comprises a backing sheet that covers the adhesive pad, and wherein the method as recited is preceded by the step of peeling the backing sheet from the adhesive pad.

* * * * *